United States Patent [19]

Lopatin et al.

[11] 4,120,141

[45] Oct. 17, 1978

[54] PROCESS AND APPARATUS FOR THE PRODUCTION OF TEXTURED POLYESTER YARN

[75] Inventors: George Lopatin, Newton Centre, Mass.; Menachem Lewin, Jerusalem, Israel

[73] Assignee: The State of Israel Ministry of Commerce and Industry, Jerusalem, Israel

[21] Appl. No.: 819,529

[22] Filed: Jul. 27, 1977

[51] Int. Cl.[2] ..... D02G 1/02

[52] U.S. Cl. ..... 57/34 HS; 57/157 S; 57/157 TS

[58] Field of Search ..... 57/34 HS, 157 S, 157 TS; 28/246, 281

[56] References Cited

U.S. PATENT DOCUMENTS

| | | | |
|---|---|---|---|
| 2,942,325 | 6/1960 | Spellman, Jr. | 28/246 X |
| 3,696,601 | 10/1972 | McCard | 57/34 HS |
| 3,796,036 | 3/1974 | Parker | 57/157 TS |
| 3,813,863 | 6/1974 | Ritter | 57/157 TS X |
| 3,910,027 | 10/1975 | Bach et al. | 57/157 TS |

*Primary Examiner*—Charles Gorenstein
*Attorney, Agent, or Firm*—Ladas, Parry, Von Gehr, Goldsmith & Deschamps

[57] ABSTRACT

An improved process is provided for simultaneously drawing and false-twist texturing of partially oriented polyester yarn. The process is of the type wherein the yarn from a supply source is passed through a yarn feed system; a heating zone in which the yarn is heated to a temperature of from about 175° to about 235° C; a cooling zone in which the yarn is cooled to a temperature below about 80° C; a false-twisting means; and take-up means whereby the yarn is drawn to a desired draw ratio; to winding up means; and is characterized in that the yarn emerging from said heating zone and before entering said cooling zone is passed through a heat-maintenance zone, in which the yarn is maintained at a temperature and for a time sufficient to permit substantially complete crystallization of the yarn so that the fully-drawn textured yarn product has a tenacity of at least 3.5 gram per denier. Apparatus for carrying out said improved process is also provided.

20 Claims, 1 Drawing Figure

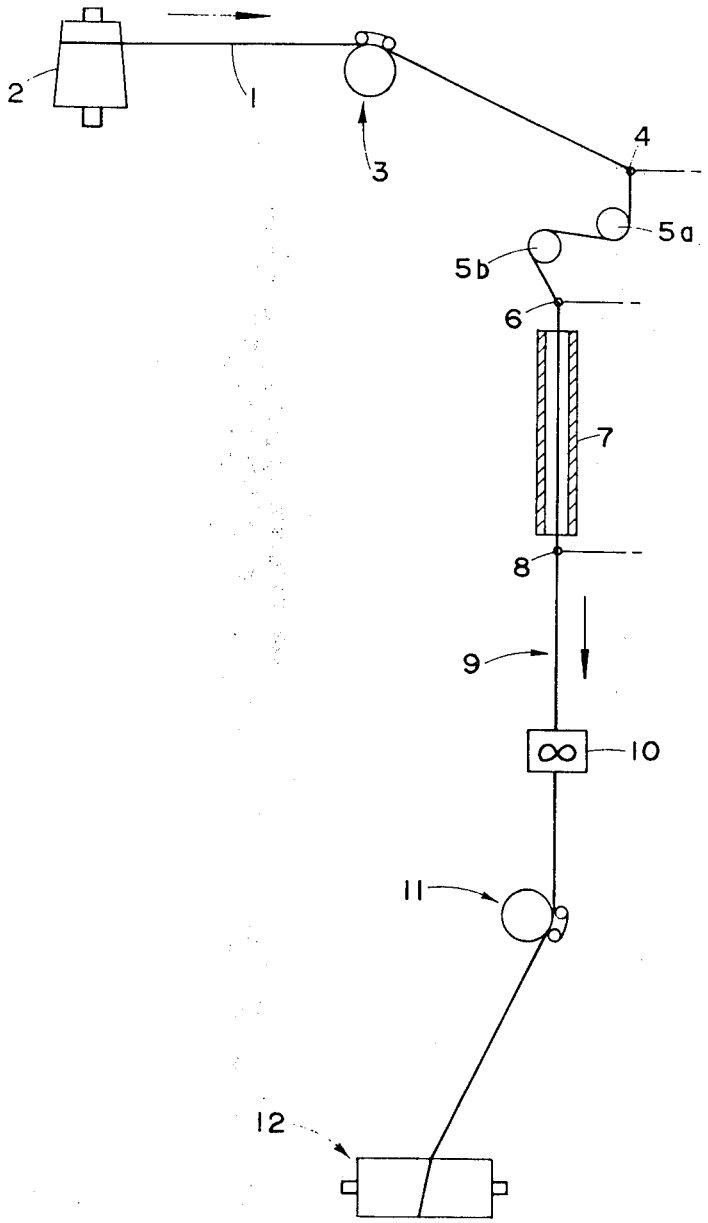
2
1
3
4
5a
5b
6
7
8
9
10
11
12

PROCESS AND APPARATUS FOR THE PRODUCTION OF TEXTURED POLYESTER YARN

This invention relates to the production of textured polyester yarn. More particularly, the invention provides an improved process and apparatus for the simultaneous drawing and false-twist texturing of partially oriented polyester (i.e., polyethylene terephthalate) yarn.

Polyester yarn, like most synthetic fibres, needs to be drawn in order to orient the molecular structure, thereby to increase the tensile strength and shelf life of the yarn. The resultant fully drawn polyester yarn is termed "fully oriented polyester yarn" (hereinafter "FOY") and has been the conventional supply yarn for false-twist texturing. With the advent of modern fast spinning processes and apparatus (with take-up speeds of 3500 mpm as compared to 1300 mpm in the conventional processes) a steadily increasing share of the polyester fibre market is being occupied by "fast spun" partially oriented polyester yarn (hereinafter "POY"). As contrasted to FOY, POY is a highly oriented but incompletely drawn yarn which still possesses a certain "residual draw ratio". POY can be textured by a so-called "draw-texturing" process which is a modification of the conventional false-twist texturing methods utilizing FOY. Basically, draw-texturing can be defined as a process wherein incompletely drawn feeder yarn is drawn to the intended yarn size and textured in a continuous manner.

False-twist texturing processes are commonly used to increase the stretch qualities and the bulk of textile yarns, and normally involve passing a moving yarn through a region where it is heated to a so-called "heat setting temperature", twisting the yarn when it is hot so that the twist becomes set in the yarn and then cooling the yarn and untwisting it. The untwisted yarn tends to return to the twisted configuration, which causes it to snarl and become stretchable and bulky. Whereas in the past false-twist texturing was as a rule performed on fully drawn (fully oriented) synthetic yarn, there has been in recent years a growing trend to use "fast spun" POY supply yarns and to perform both the drawing and the texturing operations simultaneously. The simultaneous draw-texturing of POY is claimed to yield better textured yarn with better dyeing properties from cheaper feed yarns.

In both the conventional FOY false-twist texturing and the simultaneous POY draw-texturing processes, the yarn is false-twist textured in a heated texturing zone which usually consists of a long tubular oven or a long heated surface with which the yarn is contacted. At a given temperature and a given yarn speed the oven or the heated surface had to be of a length sufficient to allow for a minimum residence time of the yarn in the heating zone. This allows the yarn to reach the necessary heat setting temperature at which the crystalline structure of the yarn relaxes or "softens" sufficiently and permits the desired molecular deformation by false-twisting to take place. For conventional FOY, residence times in the heating zone of the order of 0.3 second have been generally accepted (at the conventional heater temperatures of 175°-225° C.). This corresponds to a heater length of about 50 cm for every 100 mpm of yarn take-up speed.

The development of new high speed twisting means, such as friction twisters, have permitted the twist rates to be increased at least fivefold to about 2,000,000 turns/minute, which are required to introduce the desired degrees of twist at high yarn running speeds of 400 mpm or more. This has created a situation where the main limiting factor of the running speed in the texturing process is the length of the heaters or ovens required for sufficient residence time of the yarn therein. Thus, a heater length of 150-200 cm is generally required for texturing machines running at about 400 mpm. Bearing in mind that after exit from the oven the yarn must also pass a cooling zone of sufficient length to allow the hot twisted yarn to cool down to about 70°-80° C before it reaches the twisting means, it will be understood that such high speed texturing machines are quite space-consuming and can no longer be housed in one-storey rooms of existing plants.

It has already been proposed, in the false-twist texturing art, to replace the long primary heaters with more compact ones, such as stationary or rotatable heated pins, electric arc dischargers, etc., but the hitherto reported results of such experiments are restricted to mono- and multifilament polyamide yarns, in particular nylon 66. It has been found by the inventors that when POY Is submitted to draw texturing using hot pins as the heating means, the textured yarn obtained, though of good crimp qualities, has a tenacity which is below the minimum standard required for further processing of the yarn (about 3.3 g/dtex, or 3.5 g/den).

It has now been surprisingly found according to the invention that a textured polyester yarn of good quality and in particular of adequate tenacity can be produced from POY by a simultaneous drawing and false-twist texturing process, wherein the residence time of the yarn in the heating zone is considerably shortened, thus permitting the replacement of the long and bulky heaters with more compact heating means, such as heated pins. This is achieved in accordance with the invention by providing a temperature maintenance zone interposed between the heating zone and the cooling zone so as to maintain the yarn emerging from the heating zone at a temperature and for a time sufficient to permit substantially complete crystallization of the yarn, while the yarn passes said heat maintenance zone, resulting in a yarn having a high tenacity. In other words, in accordance with the invention, measures are taken, in the heat maintenance zone, to slow down the cooling rate of the yarn emerging from the heating zone, as compared to conventional simultaneous draw-texturing processes.

The invention thus provides a process for the simultaneous drawing and false-twist texturing of partially oriented polyester yarn, wherein the yarn from a supply source is passed through a yarn feed system; a heating zone in which the yarn is heated to a temperature of from about 175° to about 235° C; a cooling zone in which the yarn is cooled to a temperature below about 80° C; a false-twisting means; and take-up means whereby the yarn is drawn to a desired draw ratio; to winding up means; characterized in that the yarn emerging from said heating zone and before entering said cooling zone is passed through a heat maintenance zone, in which the yarn is maintained at a temperature and for a time sufficient to permit substantially complete crystallization of the yarn so that the fully-drawn textured yarn product has a tenacity of at least 3.5 gram per denier.

It has been found in accordance with the invention that, in order to ensure substantially complete crystallization of the yarn it should preferably be maintained, in said heat maintenance zone, for at least 0.05 seconds at a temperature which is lower than the temperature of the heating zone and is comprised between about 150° to about 190° C.

In one of its embodiments the invention thus provides a process for the simultaneous false-twist texturing of POY, which comprises passing the yarn from a supply source, in succession, through:

a. a yarn feed system;
b. a heating zone wherein the yarn is heated to a temperature of from about 175° to about 235° C;
c. a heat-maintenance zone, wherein the yarn is maintained for at least 0.05 secs. after it leaves said heating zone, at a temperature below said temperature of the heating zone and between about 150° and about 190° C;
d. a cooling zone wherein the yarn is cooled to a temperature below about 80° C;
e. a false-twisting means;
f. take-up means which is effecting the drawing of the yarn in said temperature maintenance zone and cooling zone; and
g. winding-up means.

As stated above, it is essential in all false-twist texturing processes to ensure that the hot twisted yarn emerging from the heater is cooled to below about 80° C before it reaches the false-twisting means, and this is usually achieved by passing the hot yarn through a cooling zone of sufficient length. It has repeatedly been proposed, mainly for space saving reasons, to shorten the cooling time, and thus also the length of the cooling zone, by the provision of various cooling aids, e.g. a current of cold air directed at the yarn. The method according to the present invention is all the more unexpected in that, in full contrast to all these attempts, the heat maintenance zone provided according to the invention, actually prolongs the total time required to cool the hot yarn from the temperature of the heating zone.

In a further aspect the invention provides apparatus for draw-texturing POY in accordance with the invention, comprising, in sequence, a feed roller system; yarn heating means adapted to heat a running yarn to a temperature of from about 175° to about 235° C; heat maintenance means adapted to maintain the yarn at a temperature below said temperature of the yarn heating means and between about 150° and about 190° C, for at least 0.05 secs. after the yarn leaves said heating zone; false-twisting means disposed at such a distance from said heat maintenance means so as to provide for an interposed cooling zone sufficient to allow the yarn to cool to a temperature below about 80° C before it reaches said false-twisting means; a draw-roller system adapted to effect drawing of the yarn to the desired draw ratio; and winding up means.

In the process according to the present invention POY from a supply creel is fed by means of a conventional feed roller system, preferably over a yarn guide, into a heating zone adapted to heat the yarn to a temperature of from about 175° C to about 235° C, preferably from about 185° to about 225° C. As pointed out above, the main advantage of the present invention resides in that the residence time of the yarn in the heating zone can be considerably shorter than the required minimum residence time of 0.3 secs. in the conventional FOY texturing process. In the process of the invention residence times as low as 0.03 secs and even lower are feasible, depending on the temperature of the heating zone and the other parameters of the process. Any kind of heating means that can rapidly raise the temperature of the yarn to the required degree and has a high rate of heat transfer can be used in the heating zone of the process according to the invention. Thus, stationary or rotating heating pins (heated "snubbing pins"), liquid metal baths, electric discharge, dielectric heating or lasers can be used.

The use of considerably more compact heating means, as compared with the conventional long heaters, leads to some further important advantages, in addition to the saving in plant space. These additional advantages are mainly:

i. a considerable saving of energy, not only in heating power but also in the power consumed in conventional texturing installations by air conditioning in order to remove the heat generated in the long primary heaters;
ii. simplification in machine construction with resultant saving in initial costs; and
iii. simpler and better control of process variables.

From the heating zone the yarn is passed, preferably with little or no intervening cooling, into a heat maintenance zone of sufficient length in order to maintain the yarn at a temperature below the temperature of the heating zone and between about 150° to about 190° C, for at least 0.05 secs., preferably at least 0.1 secs. In accordance with one embodiment of the invention, preferred because of its simplicity, the heat maintenance means consists of a tube made of a heat insulating material, such as glass or glass coated with a metallic reflecting surface, through which the yarn is passed. At yarn running speeds of 135 mpm and heating zone temperatures of 195° to 215° C glass tubes ranging from 30 to 55 cm in length with inside diameters of 1.0 to 1.3 cms. have proved to be suitable for use in accordance with the invention. More generally, glass tubes have an inner diameter of 0.5 to 3.0, preferably 0.75 to 1.25 cm and a length sufficient to provide for a residence time of at least 0.05 secs., preferably at least 0.1 secs. at the given yarn running speed, can be used.

The invention also contemplates the use of heat maintenance means comprising auxiliary heating of the yarn, e.g. an electrically heated tube surrounding the yarn.

As stated above, cooling of the hot yarn between its point of take-off from the heater means and its entry into the heat maintenance zone, should preferably be as low as possible. This means that where the heat maintenance means consists of an insulating tube, this should be disposed as close as possible to the heater means. However, it may sometimes be preferable, especially where heating zone temperatures in the upper specified range are used, to provide for an intervening cooling of the yarn to a temperature of about 170°–190° C before it is passed to the heat maintenance zone. This can be achieved by separating the heat maintenance zone from the heating zone by a distance sufficient for a yarn transit time of about 0.04 to about 0.1 secs., preferably about 0.012 to about 0.025 secs., depending on the temperature of the heating zone.

In accordance with one embodiment of the invention the yarn is passed from the heating zone to the heat maintenance zone over a yarn guide serving as a twist and draw stop, for example a wire guide around which the yarn is made to change its direction by an angle of 135° or less. Such a twist and draw stop effectively localizes the drawing at the stop and prevents any appreciable twist from "running back" upstream of said stop into the heating zone, both of which are believed to improve the homogenity of the yarn properties.

It has also been found advisable to pass the yarn immediately upon its exit from the heat maintenance zones through or over an additional yarn guide the function of which is to prevent excessive yarn vibration, particularly in the heat maintenance zone. Such vibration, mainly caused by the twisting means, has the adverse effect of increasing the rate of cooling of the yarn in the heat maintenance zone by increasing air convection at the yarn surface. As contrasted thereto, in the following cooling zone vibration of the yarn, if allowed, has a beneficial effect in that it increases the rate of cooling.

The cooling zone, in accordance with the invention, is preferably provided by a free yarn path of a length sufficient to ensure cooling of the yarn to 80° C or below, by the time it reaches the false twisting means. The length of such a cooling path will obviously depend on the temperature of the yarn at the exit point from the heat maintenance zone and where this zone is provided by an insulating tube the length of the cooling zone is a function of both the temperature in the heating zone and the length of the insulating tube (all other parameters being constant). It has been found that with a 50 cm. glass tube the transit time of the yarn through the cooling zone needed for sufficient cooling is between about 0.1 to 0.2 secs.

The false-twist means can be any conventional device such as used for texturing FOY. After passing through the twisting means the yarn passes to take-up means consisting of a draw roll system, e.g. a Casablanca apron-type system, adjusted to a suitable take-up speed necessary for fully drawing the yarn, in accordance with its residual draw ratio which is dependent, inter alia, on the speed at which the yarn was originally spun. With the commercially available POY feed yarns, this residual stretch ratio ranges from about 1.4 to about 2.5, usually between 1.6 to 1.75.

After passage through the take-up means the yarn passes to the winding up means which can also be of any conventional type.

The invention will now be described with reference to the attached drawing which is a schematic representation of a POY draw-texturing apparatus in accordance with one embodiment of the invention.

In the drawing POY yarn 1 is drawn off the supply creel 2, in the direction of the arrow, by means of a feed roll assembly 3. From the feed roll 3 the yarn is passed via a yarn guide 4 to a pair of heated pins **5*a*, 5*b*, the position of one or both of which can be adjusted so as to change the contact time of the yarn with the hot surfaces of the pins. After leaving the pin 5*b* the yarn passes through a yarn guide 6 whereby the yarn changes its direction by an angle $\alpha$ which is 135° or less, so that the yarn guide 6 serves as a draw and twist stop. Thereafter the yarn is passed through a tube 7 made of heat-insulating material and disposed immediately following the yarn guide 6. Upon its exit from the tube 7 the yarn is passed through a further yarn guide 8 acting as a vibration stop, and after travelling through a free path 9 serving as a cooling zone, the yarn passes into a false-twist means 10 which imparts to the yarn upstream of said means 10 as far back as the yarn guide 6, the desired degree of twist, simultaneously untwisting the yarn emerging from the false-twist means 10 in the downstream direction. The untwisted yarn is taken up by a draw-roller system 11 adjusted to a take-up speed which is higher than the yarn feed speed of the feed roll assembly 3 by such a ratio as to effect drawing of the yarn downstream of the draw and twist stop 6 to the desired ratio. The fully drawn textured yarn passes from the draw-roll system 11 to a wind-up station 12**.

The invention is further illustrated by the following non-limiting examples.

EXAMPLES I - IV

Polyester POY of 260 denier, 34 filaments (Monsanto type L7A) was used for all the experiments of draw-texturing according to the process of the present invention (Examples I to III) under varying process conditions as shown in Table I, and for a reference experiment (Example IV) wherein the yarn was draw-textured on heated pins but without the heat maintenance zone. For comparison, Table I also includes process conditions and results of the same POY feed yarn after being draw-textured on a conventional machine comprising a 100 cm. long tubular oven.

The experiments were run on a Barmag FK4 texturing machine (Barmag Barmer Maschinenfabrik AG, Remsheid-Lennep, West Germany) modified by Fourné (Bonn, Germany) for laboratory work and further modified for the purposes of the present invention by replacing the standard oven by two heated pins and a glass tube.

The yarn was taken from a supply creel by a Casablanca apron-type yarn feed mechanism. Thereafter the yarn was passed through a pigtail yarn guide and over a pair of heated pins (Dienes Company FDmatic hot pin type 263–1218 having diameters of 6.4 cm.) arranged as shown in the attached drawing so that both sides of the moving yarn were heated in a similar fashion. The yarn taken off from the hot pins was passed via a further pigtail yarn guide whereat the yarn changed its direction by an angle $\alpha \cong 135°$, and (in Examples I - III only) through a glass tube of a length specified in Table I and an internal diameter of 1.1 cm. The distance between the point of take-off of the yarn from the second hot pin (**5*b* in the drawing) and the yarn guide was about 5 cm. and the yarn guide 6 was positioned directly over the entrance of the glass tube. Upon exit from the glass tube, in Examples I and II but not in Example III, the yarn passed through and in contact with another pigtail yarn guide (8** in the drawing), whereafter the yarn passed through a cooling path of a length as specified in Table I and entered the false-twisting means (FAG magnetic spindle type 400) as in the standard operation of the Barmag machine for texturing FOY. From the false-twisting means the yarn passed to a Casablanca apron type draw-roller operated at a speed corresponding with the draw ratios specified in Table I, and thence to the conventional wind-up means.

In reference Example IV the glass tube was left out but the yarn guide 8 was placed about halfway between the heated pins and the false-twisting means.

The process variables and the properties of the product textured yarn are shown in the following table (I):

TABLE I

| Process Conditions | Commercial false-twist textured FOY[a] | POY draw-textured on standard machine[b] | Example I | Example II | Example III[c] | Example IV[d] (Reference) |
|---|---|---|---|---|---|---|
| Pin surface temperature (° C.) | | 215° (oven) | 196° | 212° | 212° | 213° |
| Tube length (cm) | | (100 cm oven) | 30 | 55 | 55 | —[d] |
| Cooling length (cm) | | 50 | 60 | 35 | 35 | 90 |
| Yarn speed (mpm) | | 125 | 135 | 135 | 135 | 135 |
| Stretch ratio | | 1.6–1.7 | 1.73 | 1.73 | 1.73 | 1.73 |
| Twist (turns/m) | | 2400 | 2800 | 2800 | 2800 | 2800 |
| Product properties | | | | | | |
| Tenacity[e] (T g/den) | 4.4 | 3.6 | 3.7 | 3.6 | 2.8 | 3.4 |
| Elongation[e] (E %) to break | 21 | 34 | 32 | 29 | 21 | 26 |
| $Q = TE^{\frac{1}{2}}$ [f] | 20 | 21 | 21 | 19 | 13 | 17 |
| Crimp contraction (%)[g] | 54 | 55–58 | 48 | 49 | 47 | 49 |
| Tube test (Shirley) (%)[h] | 28 | 33–36 | 31 | 31 | 31 | 31 |

[a]Standard production false-twist, single over textured (unset) yarn of 160 denier, 34 filaments, obtained from Portchester Limited, Ashkelon, Israel.
[b]Experiment conducted at Portchester Limited, Ashkelon, Israel.
[c]The vibration stop yarn guide 8 was omitted in this Example.
[d]The glass tube was omitted in this reference Example.
[e]Measured on an Instron "Tensile Tester".
[f]Cf. A.J. Rosenthal, Proceedings Symposium Polypropylene Fibres, Birmingham, Ala. 1964, pages 183–217 for discussion of the value $TE^{\frac{1}{2}}$ as an index for relating fibre tenacity and elongation.
[g]Measured by the Heberlein method as described in Chemifasern 21, January 1971, pp. 41–49.
[h]Measured by the Shirley Institute method as described in Hosiery Trade Journal, April 1971, page 115.

As seen in Table I, the properties of the POY which was draw-textured in accordance with the invention in Examples I and II, are comparable with the properties of the commercial false-twist textured FOY and those of POY draw-textured on a conventional machine. Against this the yarn produced in Example III, wherein the vibration stop yarn guide (8 in the drawing) was omitted, is quite inferior in its mechanical properties, in particular in respect of its tenacity which is reduced to below the standard minimum of 3.5 g/den. The inventors ascribe this poor result to the experimental set-up which gave rise to excessive vibrations of the yarn in its passage between the yarn guide 6 at the entry of the glass tube and the false-twister. The textured yarn obtained in reference Example IV wherein the glass tube was omitted, similarly exhibits critically inferior mechanical properties.

As regards the crimp quality of the various textured yarns, it should be pointed out that no single reliable test has yet been agreed upon in the trade for measuring these properties in draw-textured polyester POY (cf. G. J. Maureti, "Draw-Textured Yarns: A look at the testing options"; Textile Industries, March 1974, pp. 45, 87 and 89). For this reason the inventors chose to submit the product textured yarns to both the "crimp contraction test" and the "Shirley tube test". The results show that POY draw-textured in accordance with the process of the invention, including that obtained in Example III, exhibits good crimp quality which is comparable, if not better, than the commercially available false-textured FOY.

We claim:

1. A process for the simultaneous drawing and false-twist texturing of partially oriented polyester yarn, which comprises passing the yarn from a supply source, in succession, through:

a. a yarn feed system;

b. a heating zone wherein the yarn is heated to a temperature of from about 175° to about 235° C;

c. a heat-maintenance zone, wherein the yarn is maintained, for at least 0.05 secs. after the yarn leaves said heating zone, at a temperature below said temperature of the heating zone and from about 150° to about 190° C;

d. a cooling zone wherein the yarn is cooled to a temperature below about 80° C;

e. a false-twisting means;

f. take-up means which is effecting the drawing of the yarn in said temperature maintenance zone and cooling zone; and g. winding-up means.

2. A process according to claim 1, wherein the yarn is heated in the heating zone to a temperature of from about 185° to about 225° C.

3. A process according to claim 1, wherein the yarn is maintained in said heat-maintenance zone for at least 0.1 seconds at a temperature below said temperature of the heating zone and from about 150° to about 190° C.

4. A process according to claim 1, wherein the heat maintenance zone consists of a tube of insulating material through which the yarn is passed.

5. A process according to claim 4, wherein the length of the tube is such as to provide for a residence time of the yarn therein of at least 0.05 secs.

6. A process according to claim 1, wherein the yarn leaving the heating zone and before entering the heat maintenance zone is passed over a yarn guide at which the yarn is made to change its direction by an angle of 135° or less.

7. A process according to claim 1, wherein vibration of the yarn in the heat-maintenance zone is prevented by passing the yarn immediately after it emerges from the heat maintenance zone through a yarn guide.

8. A process according to claim 1, wherein the yarn passes from the heating zone to the heat maintenance zone with no substantial intervening cooling.

9. A process according to claim 1, wherein the temperature of the yarn in the heating zone is above 190° and the yarn leaving the heating zone is allowed to cool to a temperature of about 170° to 190° C.

10. A process according to claim 1, wherein the yarn is drawn at a draw ratio of from about 1.5 to about 1.75.

11. Apparatus for the simultaneous drawing and false-twist texturing of partially oriented polyester yarn, comprising in sequence:

a yarn feed system;

yarn heating means adapted to heat the yarn to a temperature of from about 175° to about 235° C;

heat maintenance means adapted to maintain the yarn at a temperature below said temperature of the heating means and between about 150° and about 190° C., for at least 0.05 secs.;

false-twisting means disposed at such a distance from said heat maintenance means so as to provide for an interposed cooling zone sufficient to allow the yarn to cool to a temperature below about 80° C before it reaches said false-twisting means;

a draw-roller system adapted to effect drawing of the yarn to the desired draw ratio; and winding-up means.

12. Apparatus according to claim 1 wherein the yarn heating means consists of a heated pin.

13. Apparatus according to claim 1 wherein the yarn heating means consists of a pair of heated pins.

14. Apparatus according to claim 11, wherein the heat maintenance means consists of a heat insulating tube.

15. Apparatus according to claim 14, wherein the length of the tube is such as to provide for a residence time of the yarn therein of at least 0.05 secs.

16. Apparatus according to claim 14 further comprising auxiliary heating means adapted to heat at least a part of said tube.

17. Apparatus according to claim 11, wherein the heat maintenance means is disposed substantially adjacent the take-off point of the yarn from the heating means.

18. Apparatus according to claim 11, wherein the heat maintenance means is disposed at such a distance from the heating means as to effect cooling of the yarn to a temperature of about 170° to 190° C before it enters said heat maintenance zone.

19. Apparatus according to claim 11, further comprising a yarn guide disposed adjacent the entry of the yarn into the heat maintenance means and adapted to act as a draw and twist stop.

20. Apparatus according to claim 11, further comprising a yarn guide disposed adjacent the exit of the yarn from the heat maintenance means and adapted to act as a vibration stop.

* * * * *

UNITED STATES PATENT AND TRADEMARK OFFICE

CERTIFICATE OF CORRECTION

PATENT NO. : 4,120,141

DATED : October 17, 1978

INVENTOR(S) : George LOPATIN et al

It is certified that error appears in the above-identified patent and that said Letters Patent are hereby corrected as shown below:

On the title page, left-hand column, insert the following:

[30] Foreign Application Priority Data

Aug. 2, 1976 Israel .....50185

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*